United States Patent [19]

Wojdyla et al.

[11] 4,030,677

[45] June 21, 1977

[54] RECORD MEDIA REWIND MECHANISM

[75] Inventors: Gary A. Wojdyla; Kenneth W. Hanna, both of Ithaca, N.Y.

[73] Assignee: NCR Corporation, Dayton, Ohio

[22] Filed: Mar. 8, 1976

[21] Appl. No.: 665,036

[52] U.S. Cl. ..... 242/65; 242/67.3 R

[51] Int. Cl.[2] ..... B65H 17/08

[58] Field of Search ..... 242/65, 67.1 R, 67.3 R, 242/192

[56] References Cited

UNITED STATES PATENTS

| | | | |
|---|---|---|---|
| 186,256 | 1/1877 | Jones | 242/65 |
| 776,260 | 11/1904 | Robertshaw | 242/65 |
| 2,194,078 | 3/1940 | Simonds | 242/65 |
| 2,509,684 | 5/1950 | Higgins | 242/65 X |
| 3,834,638 | 9/1974 | Savage | 242/67.1 R |

*Primary Examiner*—Edward J. McCarthy
*Attorney, Agent, or Firm*—J. T. Cavender; Wilbert Hawk, Jr.; George J. Muckenthaler

[57] ABSTRACT

Paper or like record media from a supply roll is driven past a printing station and is rewound on a rotatable core member which is movable away from a drive roller against the bias of a pair of springs. The roller drives the core member through engagement with the record media thereon, the core not being independently driven, so that the increase in diametric size of the record media on the core member has no effect on the index length or linear motion of such media throughout the overall driving thereof.

18 Claims, 4 Drawing Figures

RECORD MEDIA REWIND MECHANISM

BACKGROUND OF THE INVENTION

In business machines especially of the retail and/or financial terminal type, there are usually provided a plurality of printing devices for accomplishing functions such as the issuing of a receipt of the particular transaction for distribution to the customer, the retaining or storing of all transaction information in the machine as a permanent record, and the printing of certain information on slips, forms, or like documents for retention by the business or the printing of certain information in a pass book or the like for the benefit of and return to the customer.

This invention is directed to the second above-mentioned function of retaining or storing a record of each transaction within the machine, commonly referred to as a journal or audit trail.

While various ways and means are known for accomplishing the driving and rewinding of a journal record in a machine, the common practice for providing such function is to provide a supply roll of the recording media, drive such record media past a printing station, and then rewind the media, with the printed transaction thereon, around a take-up roll or spool within the machine until such roll or spool is filled, whereupon same is then removed from the machine for auditing or like further processing. In one case, the take-up spool is separately driven from a main drive line which may also drive a different record media for a receipt or a slip transaction. In another case, the take-up spool is driven by means of the spool being in frictional contact with a drive member, the actual drive being accomplished from the member in contact with the record media and not by reason of an independent drive for the spool. Representative of the use of a ring or belt as a drive member for one type of journal or audit drive is disclosed in U.S. Pat. No. 3,834,638 to J. G. Savage

SUMMARY OF THE INVENTION

The present invention relates to printers and more particularly to record media drive mechanism and the method and apparatus for rewinding and indexing the journal or audit trail. A pair of machine frame members are spaced apart to provide a pathway for the paper or like record media as it travels from the supply roll to the take-up roll. A drive roller is positioned within the frame members and is affixed to and driven from a shaft journaled in the frame members and extending on one side thereof and connected to a clutch member driven in indexing manner from a prime mover. A take-up spool or core member is inserted between the frame members and is biased into contact with the drive roller, the spool having shaft ends which slide in slots in the frame members for up-and-down movement of the spool. The paper is sandwiched between the drive roller and the spool or core and the spool is biased or urged in the downward direction by means of a pair of springs connected through a pair of arms which are slidingly movable in relation to the frame by means of studs secured to the frame members and which arms have slots therein operable with the studs as the arms are moved in the up and down direction. The arms have portions formed at the upper ends thereof to fit around shaft bearings on either side of the spool to permit freedom of rotation of the spool between the frame members. As the paper is wound on the core, the diameter thereof increases and the core is caused to be moved upwardly away from the drive roller. The core is not independently driven but is driven through the drive roller which serves to rotate the core through contact of the paper with the drive roller as the paper is wound around the core. In this manner the increase in diameter of the paper on the core has no effect on the indexing length of linear motion of the paper as it is rewound on the core. When the core is filled, it is easily removed from the frame members by pulling upwardly on such filled core, the arms being pivoted out of the path of the shaft ends to release the core.

In view of the above discussion, the principal object of the present invention is to provide a journal take-up roll which is driven by engagement with the journal paper without the requirement of independent drive means for the take-up roll.

Another object of the present invention is to provide a journal take-up roll wherein the increased diameter of the paper thereon has no effect on the indexing length or the linear motion of the journal paper.

An additional object of the present invention is to provide a spring loaded journal take-up roll to insure positive contact between the journal paper and the driving roller as the paper is rewound on the take-up roll.

A further object of the present invention is to provide a journal take-up roll which is structured to be positively retained in driving relationship with the driving roller but is easily removable from the supporting members.

Additional advantages and features of the present invention will become apparent and fully understood from a reading of the following description taken together with the annexed drawing, in which.

Figure 1:
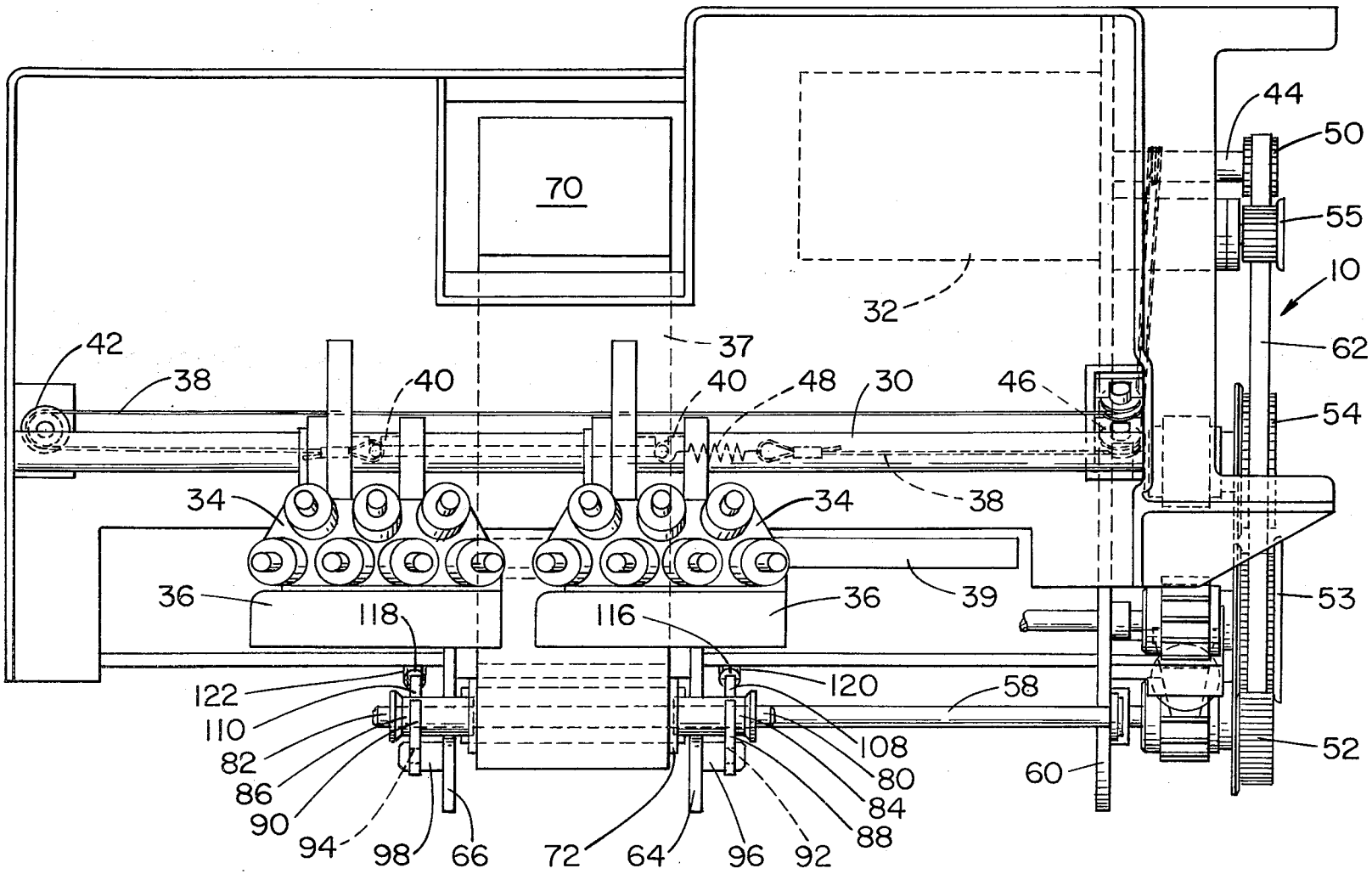
FIG. 1 is a top plan view of a printer incorporating the subject matter of the present invention.
Figure 2:
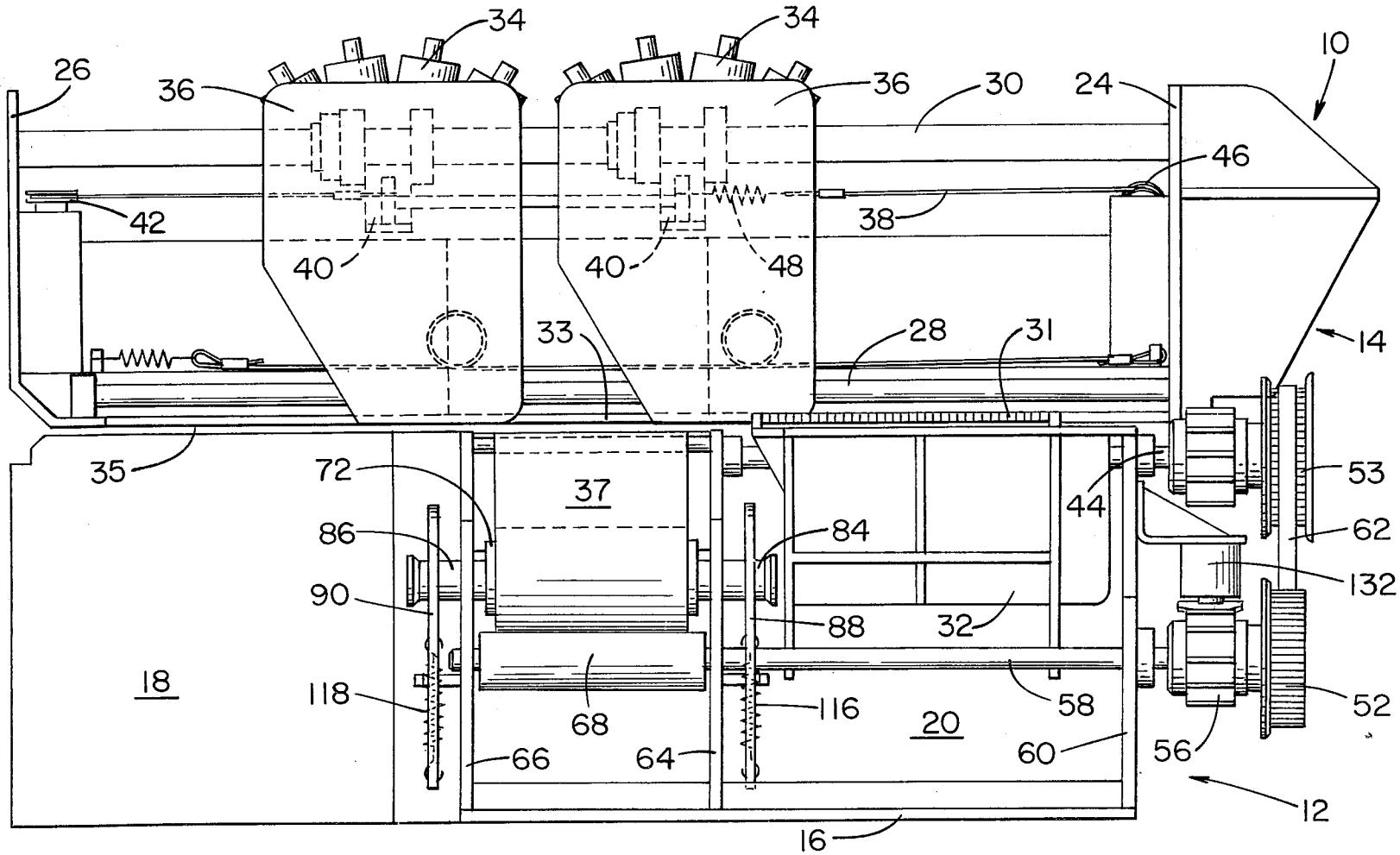
FIG. 2 is a front elevational view of the printer shown in FIG. 1.

Referring now to FIGS. 1 and 2 of the drawing, there is shown printer structure of limited illustration wherein a business machine designated generaliy as 10 has lower and upper portions 12 and 14, respectively, the lower portion including a supporting base 16 and enclosure panels 18 and 20 for containing various machine elements not a part of the present invention. The upper portion 14 of the machine includes side walls 24 and 26 connected by suitable rods or rail members, there being a pair of rods or shafts 28 and 30, for a purpose to be later described, along with additional connecting frame members for carrying the printing mechanism.

A prime mover, which may be in the form of a continuous run motor 32, is located at the right, lower rear area of machine lower portion 12 and such motor supplies energy for the various operating members of the machine, one of which is printing mechanism which is made to travel in a side-to-side direction for effecting the printing operation.

Although the printing mechanism may be one of several types, the present structure is directed to a design which includes matrix type printing mechanism positioned in a generally upright manner and carried or driven back and forth across the machine. The printing mechanism may comprise one or more print heads for operating at one or more print stations. In a business machine of the printer type with which the present invention may be particularly useful, a plurality of such print stations may be appropriately named a receipt station 31, a journal station 33, and a slip or form station 35. Inasmuch as the present invention is directed to record media rewind mechanism, the journal station 33 is most applicable here by reason of the storage of the paper or like record media 37 on a take-up roll in the machine. Additionally, although a single print head may be useful in effecting the various printing operations, a plurality of print heads 34 are shown in relation to the structure of the present invention as associated therewith. Forward of the print heads and connected thereto to be carried thereby may be ribbon cassettes 36, the structure and function of which is not directly related to the present invention and therefor will not be described in detail.

The print heads 34 and the cassettes 36 may be moved in such back and forth motion and operable with a printing platen 39 by means of a cable or cord 38, one end being securely connected to an attaching point in the form of a block 40 on the rear of the print heads 34, the cable extending leftwardly toward and around a pulley 42, journaled at the left side frame 26, and returning in a path rightward and rearward of the print heads 34, toward and around a pulley, thence downwardly toward and around a helical-type gear on the shaft 44 of the motor 32, upward toward and around a pulley 46, and leftward toward the attaching block 40, there being a spring 48 connected at one end thereof to the block 40 and interposed between the block and the other end of the cable for providing proper tension therein. By appropriate control mechanism, the motor 32 drives, by means of the cable 38 and the various pulleys, the print heads 34 and the cassettes 36 in the desired side-to-side motion for printing. The shafts 28 and 30 provide guide means to carry the print heads 34 and the cassettes 36 in a precise path for operation with the platen 39 as the heads are caused to be driven by the cable 38 in back and forth travel.

Figure 3:
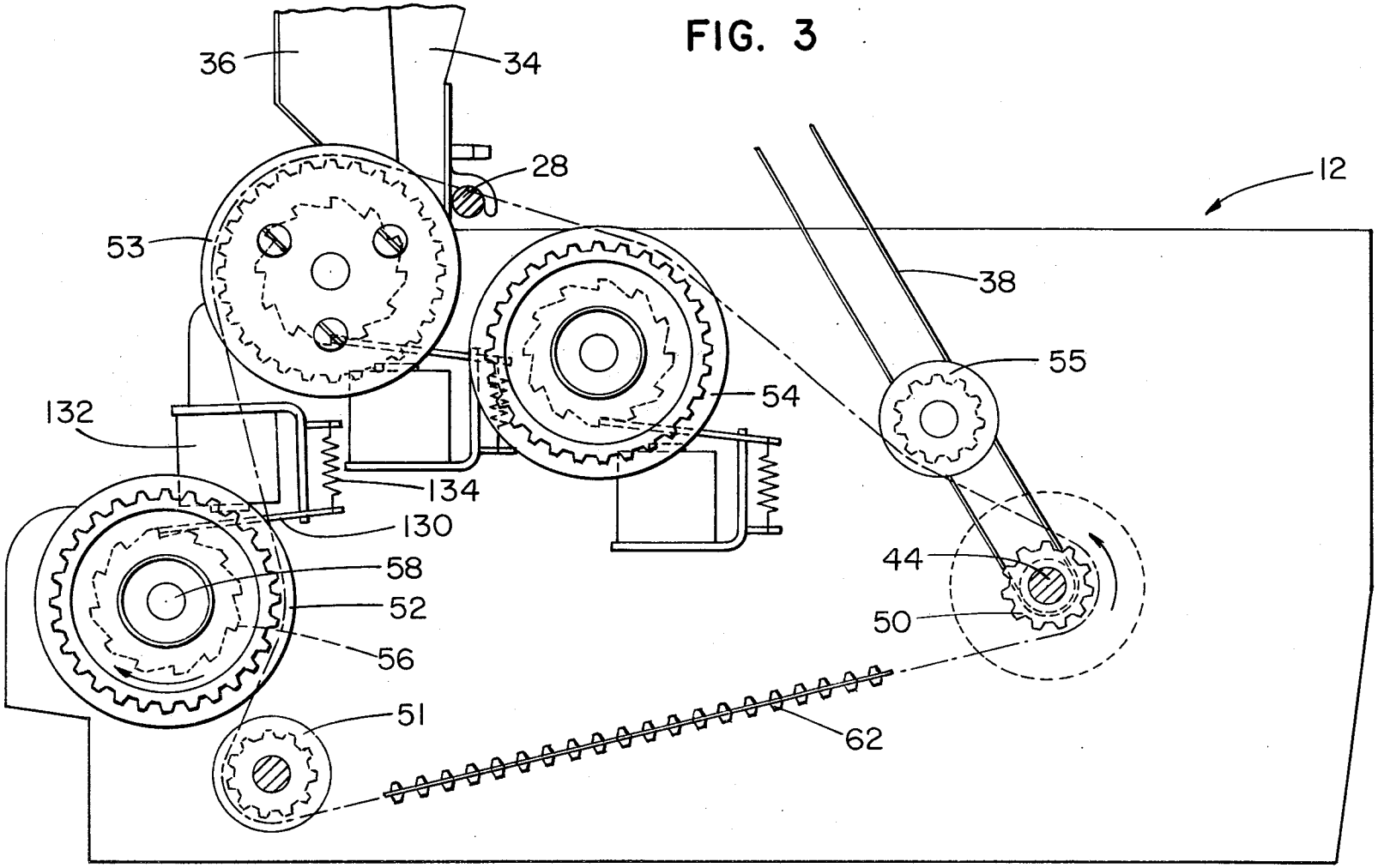
FIG. 3 is a side elevational view of certain printer drive mechanism for the journal take-up roll assembly and for other driven parts.

In FIGS. 1, 2, and 3, the drive for the various machine parts is taken off the motor shaft 44 which has a pulley 50 secured thereto, there being in the drive line a timing pulley 51, a journal feed pulley 52, a receipt drive pulley 53, a slip drive pulley 54, and an idler pulley 55.

Figure 4:
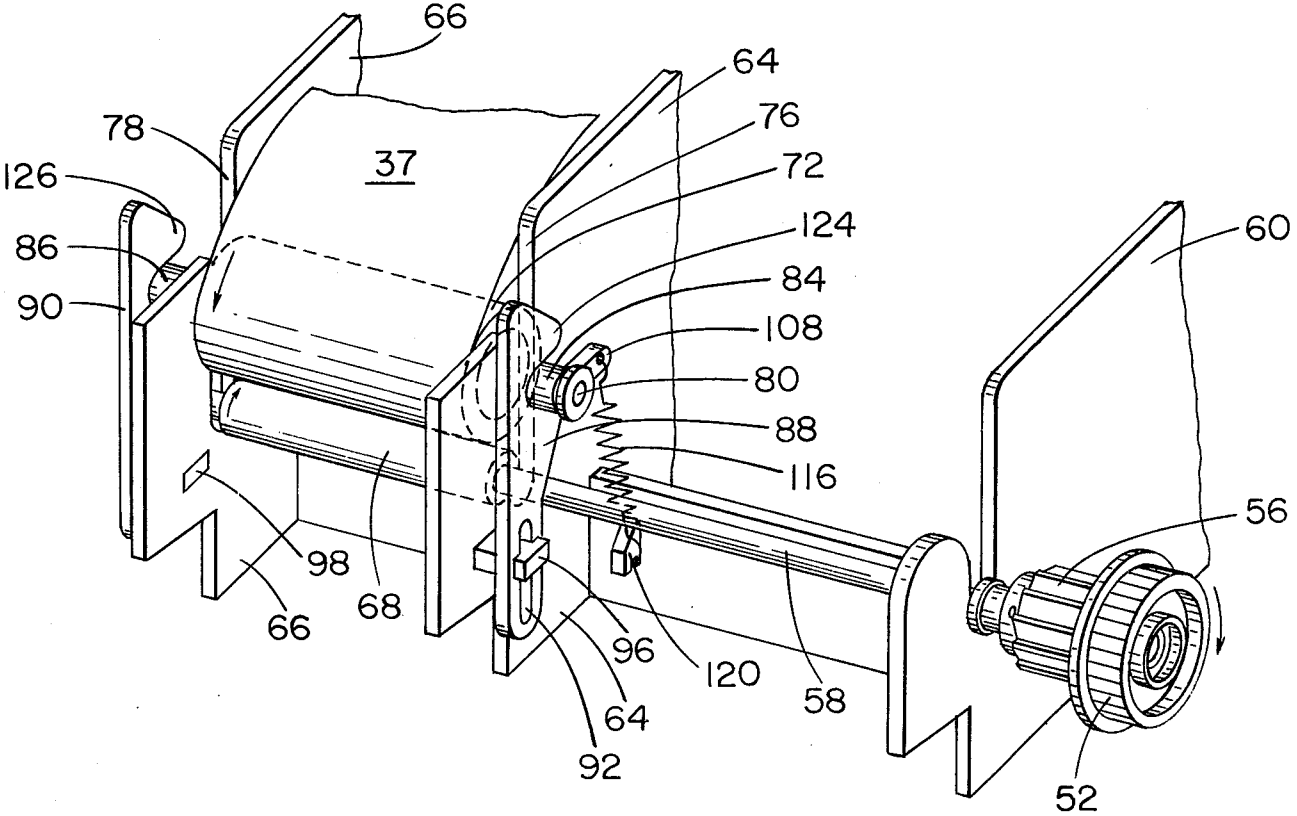
FIG. 4 is a perspective view of the journal take-up roll and the drive therefor.

Referring now to FIGS. 3 and 4, the drive for the journal rewind and indexing assembly originates from a twelve-position spring clutch 56, supported from an input shaft 58, and operably connected with the pulley 52 on the shaft 58, and with a belt 62 being trained around the various pulleys to the motor pulley 50. Shaft 58 extends leftwardly through and is journaled in a lower side wall 60 and in a pair of frame walls 64 and 66 which include suitable journal or bearing means, there being a drive roller 68, having a frictional surface, secured to the shaft and positioned between the walls 64 and 66. The diameter of the roller 68 may be designed to coincide in relative dimension to the number of positions on the spring clutch to determine the length of paper 37 that will be indexed during a printing operation. The frame walls 64 and 66 may also act as guides for the journal paper 37 as it travels from a supply roll 70 to a take-up or journal roll. It is understood, of course, that a supply of receipt paper and a supply of journal paper are retained in wells or bins commonly located at the rear of the machine in the upper portion thereof. The take-up or journal roll 72 is a cylindrical core that is supported between the frame walls 64 and 66, the core having a longitudinal slot therein for insertion of the leading edge of the journal paper 37 for starting the rewinding or spooling of the paper. The frame walls 64 and 66 have generally vertical slots 76 and 78 therein for reception of the take-up roll 72 and extending in sufficient depth to permit contact of the perimeter of the roll 72 with the perimeter of the drive roller 68. The roll 72 includes shaft ends 80 and 82 that protrude beyond the frame walls 64 and 66 and bearings 84 and 86 are provided for the shaft ends to permit free rotation of the roll in the bearings, the slots 76 and 78 being of a dimension to accommodate the diameter of the bearings for slidably riding up and down therein.

The drive for rewinding the journal paper 37 on the take-up roll 72 is completed by the frictional contact of the drive roller 68 with the paper as it is wound on the roll 72, it being necessary to provide and maintain a downward force on the roll 72 to insure such frictional contact. The downward force is accomplished by means of a pair of support arms 88 and 90 having generally vertical slots 92 and 94 at the lower portions thereof for reception of guide pins or the like to permit up and down movement of the arms. As shown in FIG. 4, a pair of rectangular-shaped studs 96 and 98 are attached to the frame walls 64 and 66 and extend outwardly therefrom with reduced portions thereof positioned within such vertical slots 92, 94 for guiding action of the arms 88 and 90. The arms 88 and 90 include fingers 108 and 110 having apertures in the ends thereof for reception of one end of a pair of springs 116 and 118, the other end of the springs being attached to lugs 120 and 122 secured to extensions of the walls 64 and 66. The upper ends of the arms 88 and 90 have curved portions 124 and 126 formed to extend partially around the bearings 84 and 86 in captive arrangement, as best shown in FIG. 4.

It is seen that the arms 88 and 90 are not attached to the take-up roll 72 but are slidably supported by the reduced portions of the studs 96 and 98 and are engageable by means of the curved portions 124 and 126 with the bearings 84 and 86. Since it is necessary to conveniently remove the take-up roll 72 from the frame walls 64 and 66, the arms 88 and 90 are structured to thus permit such removal.

It is also noted that the take-up roll 72 is not positively driven but derives its rotation through the contact of the drive roller 68 with the journal paper 37 as it is wound on the roll 72. The assembly does not increase the indexing length or affect the linear motion of the paper 37, regardless of the size of the take-up spool 72 or of the rising position assumed thereby in relation to the drive roll 68 upon rewinding of the paper thereon.

When the take-up roll 72 is filled with the paper 37, it is easily removed from the printer by raising such roll upwardly against the action of the spring-loaded arms 88 and 90, the upward force being sufficient to slip the curved portions 124 and 126 from the bearings 84 and 86 by means of pivot action of the arms 88 and 90 at the reduced portions of the studs when such reduced portions are at the bottom of the slots 92 and 94 in the arms 88 and 90.

In the operation of the journal paper rewind mechanism, the drive for the same originates from the motor 32,, through the timing belt 62 and drives the various pulleys associated with the respective functions of the printer, i.e. the printing of the receipt, journal, and form or slip. As the motor 32 is continuously driven in one direction, a plurality of clutches together with their release solenoids are operated at precise times to cause the record media to be advanced normally in indexing manner. In the matter of the journal drive the pulley 52 is rotated in a clockwise direction (FIG. 3), the shaft 58 and the drive roller 68 being held from rotation by the arm 130 of release solenoid 132 being in contact with a tooth of the clutch 56. When it is desired to advance the journal paper 37, an appropriate signal is pulsed to the solenoid 132 and the arm 130 is moved from the tooth of the clutch to enable rotation of the shaft 58 and the drive roller 68, which roller 68 drives the journal paper 37 by means of the biased contact of such paper with the roller 68. Upon deenergizaton of the solenoid 132, a spring 134 causes return of the arm 130 to the contact position with a tooth of the clutch 56. As the journal paper 37 is rewound on the spool or core member 72, the increase in diameter causes the spool to move away or in the upwardly direction from the drive roller 68 and against the bias of the springs 116 and 118 acting on the arms 88 and 90, such arms moving upwardly by reason of the connection of the curved portions 124 and 126 with the bearing members 84 and 86 of the spool 72. The arms 88 and 90 are guided in such upward direction by the studs 96 and 98 operating in the slots 92 and 94 of the arms. When the spool 72 is filled with the journal paper 37, the arms 88 and 90 have been elevated to the position where the reduced portion of each of the studs 96 and 98 is at the lower end of the slots 92 and 94, thereby acting as an upward stop for the arms. The filled spool 72 is the rocked forwardly whereby the studs 96 and 98 act as pivot points to permit release of the curved portions 124 and 126 from the bearing members 84 and 86 and removal of the spool from the machine.

It is thus seen that herein shown and described is a rewind mechanism for journal paper in a printer wherein the take-up roll is free to move as the diameter of the paper on the roll is increased, the increasing diameter having no effect on the indexing length or the linear motion of the paper, and wherein the take-up roll is easily removable when filled to its normal capacity. The mechanism enables the accomplishment of the objects and advantages mentioned above, and while one embodiment of the invention has been disclosed herein, variations thereof may occur to those skilled in the art. It is contemplated that all such variations, not departing from the spirit and scope of the invention hereof, are to be construed in accordance with the following claims.

What is claimed is:

1. A take-up assembly for record media comprising frame means, rotary drive means journaled in said frame means, roller means adjacent said drive means for winding of said record media on said roller means by driving contact of said drive means with said record media, and support means operably associated with said roller means and pivotally movable with respect to said frame means permitting said roller means to move from said drive means upon winding of said record media on said roller means and permitting removal of said roller means from said frame means.

2. The assembly of claim 1 including resilient means urging said roller means in the direction of said drive means.

3. The assembly of claim 1 including guide means connected with said frame means permitting said support means to operate with said roller means independent of said frame means.

4. The assembly of claim 1 including bearing means on said roller means operably associated with said support means and permitting removal of said roller means independent of said frame means.

5. The assembly of claim 1 wherein said frame means comprises spaced members positioned to guide said record media to said roller means.

6. The assembly of claim 1 wherein said roller means comprises a take-up roll having end members operably associated with said support means permitting movement thereof independent of said frame means.

7. The assembly of claim 1 wherein said support means comprises a pair of arm members pivotally connected with said frame means and engageable with said roller means permitting said roller means to move away from said drive means upon winding of said record media on said roller means and permitting removal of said roller means from said frame means.

8. The assembly of claim 1 wherein said frame means defines slots therein and said roller means includes bearing members thereon and slidable in said slots as said record media is wound on said roller means.

9. In a printer, means for storing record media by rewinding thereof, said means comprising spaced frame members, a drive member journaled in said frame members, roller means adjacent said drive member and positioned to receive said record media, said record media being directed in a path between said drive member and said roller means to be rewound thereon by contact of said drive member with said record media, and means pivotally connected with said frame members and supporting said roller means in an arrangement permitting said roller means to be movable toward and away from said drive means and permitting removal of said roller means from said frame means.

10. In the printer of claim 9 including resilient means urging said roller means toward said drive member.

11. In the printer of claim 9 including pivot means connected with said frame members permitting said connected means to operate with said roller means independent of said frame members.

12. In the printer of claim 9 including bearing means on said roller means operably associated with said connected means to permit removal of said roller means independent of said frame members.

13. In the printer of claim 9 wherein said roller means comprises a take-up roll having end members operably associated with said connected means permitting movement thereof independent of said frame members.

14. In the printer of claim 9 wherein said connected means comprise a pair of arm members pivotally connected with said frame members and engageable with said roller means permitting said roller means to move from said drive member upon winding of said record media on said roller means and permitting removal of said roller means from said frame members.

15. In the printer of claim 9 wherein said frame members define slots therein and said roller means includes bearing members thereon and slidable in said slots as said record media is wound on said roller means.

16. A method of rewinding record media in a business machine having frame members spaced to guide said record media, comprising the steps of:

providing a drive roller for operation within and journaled in said frame members, providing a rewind roller within said frame members and adjacent said drive roller for operation therewith, driving said drive roller in contact with said record media, and providing means pivotally connecting said frame members and supporting said rewind roller for permitting said rewind roller to move from said drive roller as said record media is directed between said drive roller and said rewind roller during the rewinding of said record media thereon and permitting removal of said rewind roller from said frame members.

17. The method of claim 16 further permitting movement of said rewind roller from said drive roller in a controlled path as the record media diameter is increased on the rewind roller.

18. The method of claim 16 further providing resilient means urging said rewind roller in the direction of said drive roller.

* * * * *